US008079868B2

(12) United States Patent
Stone et al.

(10) Patent No.: US 8,079,868 B2
(45) Date of Patent: Dec. 20, 2011

(54) ELECTRICAL CONNECTOR WITH RELEASABLE LOCKING CLIP

(75) Inventors: Randall G. Stone, McHenry, IL (US); Joseph F. Murphy, Highland Park, IL (US)

(73) Assignee: Molex Incorporated, Lisle, IL (US)

( * ) Notice: Subject to any disclaimer, the term of this patent is extended or adjusted under 35 U.S.C. 154(b) by 147 days.

(21) Appl. No.: 12/715,492

(22) Filed: Mar. 2, 2010

(65) Prior Publication Data

US 2010/0233904 A1 Sep. 16, 2010

Related U.S. Application Data

(60) Provisional application No. 61/159,720, filed on Mar. 12, 2009.

(51) Int. Cl.
*H01R 9/05* (2006.01)

(52) U.S. Cl. ..... 439/578; 439/353; 439/923

(58) Field of Classification Search ..... 439/578, 439/352, 353, 357, 358, 483, 923
See application file for complete search history.

(56) References Cited

U.S. PATENT DOCUMENTS

| | | | | |
|---|---|---|---|---|
| 5,056,756 | A * | 10/1991 | Norkey et al. | 251/149.6 |
| 5,988,705 | A * | 11/1999 | Norkey | 285/319 |
| 7,862,366 | B2 * | 1/2011 | Stone et al. | 439/352 |
| 2006/0172579 | A1 * | 8/2006 | Murphy et al. | 439/307 |

* cited by examiner

*Primary Examiner* — Tulsidas C Patel
*Assistant Examiner* — Travis Chambers
(74) *Attorney, Agent, or Firm* — Larry I. Golden

(57) ABSTRACT

An electrical connector includes first and second connector members each having respective complementary connecting elements, with the second connector member having an annular insert adapted for tight-fitting insertion in an annular recess of the first connector member. Attached to the second member is a circular spring having inwardly directed resilient tines which engage an outer surface of the second member for coupling the two connector members together in a locked manner. Attached to and disposed about the first member is a fixed apertured outer sleeve and the movable combination of an apertured inner sleeve and a release sleeve. Insertion of the flat blade of a tool into an aligned pair of outer and inner apertures, followed by rotation of the tool, causes its blade to displace the release sleeve into engagement with the spring, bending its tines and releasing the two connector members from one another.

14 Claims, 5 Drawing Sheets

FIG.5
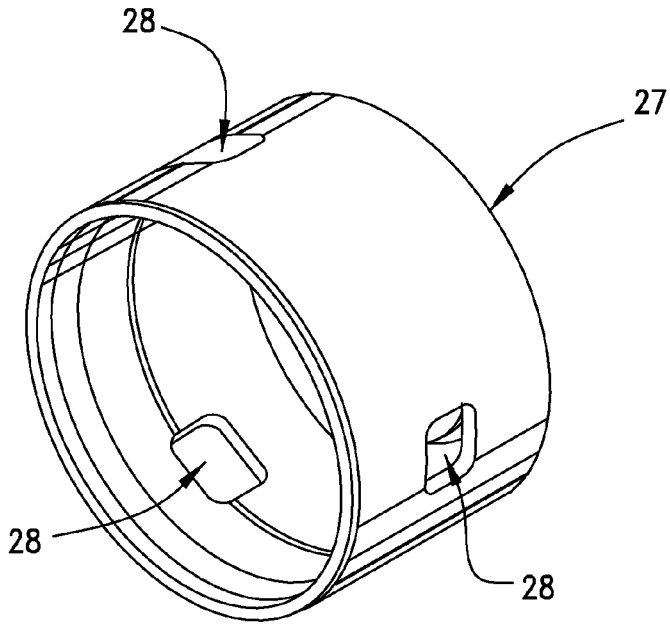
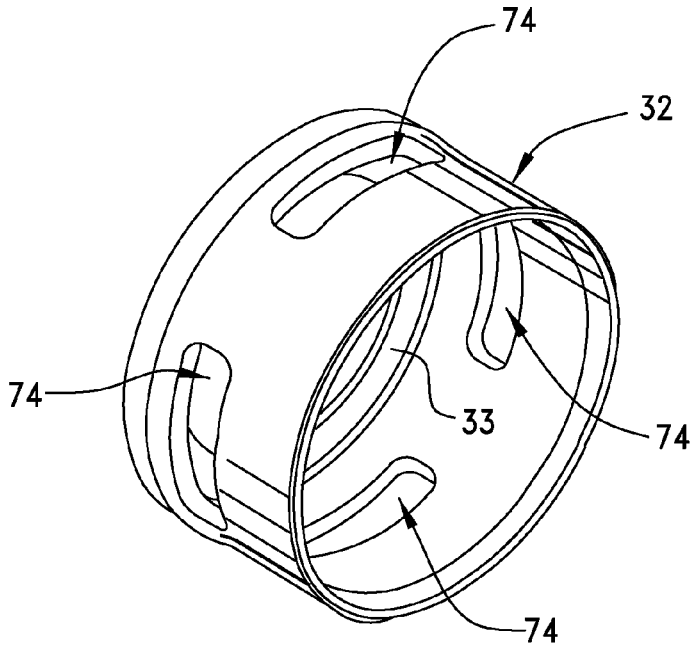
FIG.6

ELECTRICAL CONNECTOR WITH RELEASABLE LOCKING CLIP

FIELD OF THE INVENTION

This invention relates generally to electrical connectors and is particularly directed to an electrical connector having a locking feature for increased safety and security.

BACKGROUND OF THE INVENTION

In some applications, such as environments including hazardous, combustible or explosive gases, referred to as "Zone II" applications, it is desirable to have a secure coupling between male and female electrical connectors so that the connectors cannot be inadvertently disconnected which can cause a possible arc or inadvertently interrupt the operation of a machine on a production line. Thus, it is desirable to have a locking feature in such connectors. However, in the case of an urgent matter or simply for convenience, it is also desirable that the two connectors may be disconnected by a tool which is normally in the immediate area. A common blade screw driver is such an acceptable, convenient tool, but its application to a connector in an unlocking procedure, must be convenient and safe.

OBJECTS AND SUMMARY OF THE INVENTION

The present invention relates to an electrical connector assembly comprising a male and a female connector. For convenience, one connector, which may be either the male or female, is referred to as the "first" connector, and the other connector is referred to as the "second" connector. The first connector includes a retainer spring for releasably securing the two connectors together.

The electrical connectors with which the illustrated embodiment is concerned are plug type connectors. In particular, the connecting element may be pins (on one connector) and sleeves on the other. Typically, a plug type connector is connected at the end of a cable including an outer insulating sheath. As used herein, "forward" refers to the direction of insertion of a connector (whether it is the male connector or the female connector). Thus, both connectors are moved in the "forward" direction in order to accomplish connection. Second, the term "axial" refers to the axis of a cable which passes through the center of the connector and the term "radial" refers to a direction in a plane perpendicular to the "axis" as defined. Thus, male and female plug connectors are assembled or "connected" by passing the two connectors, each in a "forward" direction along an "axial" line passing through the center of both connectors. These terms are for convenience and clarity of description and not intended to be limitations of the invention. In the illustrated embodiment, the female connector has socket elements for receiving associated connector pins on the male connector.

The first connector (male or female) includes a generally annular retainer spring having a circular base or ring and inwardly (i.e., centrally) projecting flexible tines which are inclined slightly in the direction of insertion of the second connector. The inner edges of the tines define an opening for receiving and coupling to the outer surface of a cylindrical insert of the second connector. As the second connector is assembled to the first connector, the cylindrical insert of the second connector engages the tines of the retainer spring and deflects the tines of the retainer spring in the direction of insertion of the second connector, thereby enlarging the receiving opening formed by the distal ends of the tines, and admitting the second connector to the coupling position. Upon insertion, the distal ends of the tines lock against the outer surface of the second connector (in the illustrated embodiment, by means of a peripheral rim) thereby preventing separation of the two connectors.

The first connector has an axially slidable member referred to as an inner sleeve, which is provided with a forward flange ("forward" in the direction of connection of the first connector), in the form of an annular wall. The forward flange or annular wall of the inner sleeve, in the connected position of the connector, engages a forward portion of a spring actuator or release sleeve which unlocks the two connectors through the use of a common tool such as a blade screw driver.

The outer sleeve of the first connector is received on the inner sleeve, and the outer sleeve includes a rear wall which fixes the outer sleeve against movement in an axial (connecting) direction, but permits free rotation of the outer sleeve about the axis of the connector.

The inner sleeve is also freely rotatable. The outer sleeve has a first plurality of openings, each extending in a circumferential direction over a limited distance, and the inner sleeve has a second plurality (preferably different in number from the first plurality of openings of the outer sleeve) which also extend circumferentially over a limited distance. The openings on the outer sleeve and the openings on the inner sleeve are constructed and arranged so that at least one pair of openings (that is, one on the outer sleeve and one on the inner sleeve) align to form a space sufficient to receive the blade of a common tool, such as a screw driver. Each of the first plurality of openings disposed on the circumferential, cylindrical side wall of the outer sleeve includes a respective first reaction surface at the forward end of each opening. Similarly, each of the second plurality of openings disposed on the circumferential, cylindrical side wall of the inner sleeve includes a respective second reaction surface at the rear end of each opening. The first reaction surfaces on the outer sleeve are axially spaced from the second reaction surfaces on the inner sleeve.

When the second connector is assembled to the first connector, the plug of the second connector engages the tines of the retainer spring of the first connector and displaces inner portions of the tines in the direction of insertion, thereby bending the tines so that the inner edges of the tines form an enlarged opening for receiving the plug of the second connector. The plug of the second connector may include a circumferential rim which passes beneath the opening tines of the first connector; and the tines engage the rear end of the circumferential rim to lock the two connectors together.

The spacing between the second reaction surfaces on the inner sleeve (which extend generally in a radial plane) and the first reaction surfaces on the outer sleeve (which also extend generally in a radial plane) is such as to receive the blade of a common, generally available tool such as a screw driver. The distance between the two reaction surfaces (one on the rear portion of an opening on the inner sleeve and the other on the forward portion of an opening on the outer sleeve) when the openings are aligned defines a space which is approximately equal to the width (i.e., shorter dimension) of the blade of the tool.

Thus, when the blade of the uncoupling tool is inserted through corresponding aligned openings, one in the outer sleeve and one in the inner sleeve, one lateral edge of the lower end portion, or tip, of the tool blade engages a reaction surface of an opening on the inner sleeve and the opposite lateral edge of the blade engages a reaction surface on the outer sleeve. When the tool is then twisted about its longitudinal axis (i.e., along a radius of the two connectors), the inner sleeve is moved rearwardly relative to the first connector (i.e., in the direction of connection for the second connector). This forces the inner sleeve of the first connector rearwardly, and the forward flange of the inner sleeve engages a forward surface of the actuator sleeve, causing the actuator sleeve to engage inner end portions of the tines of the retainer spring and urge them rearwardly to enlarge the opening formed by the inner end portions of the tines of the retainer spring, thus freeing the plug of the second connector so that it may be removed from the first connector.

In the illustrated and preferred embodiment, there are three equally spaced openings disposed about the circumference of the outer sleeve and four equally spaced openings disposed about the circumference of the inner sleeve. Preferably, the size, number and spacing of the openings on the inner and outer sleeves is such that there is always one slot on the outer sleeve which is aligned with one slot on the inner sleeve to provide a space to receive a disconnecting tool having a blade-type edge.

The openings on the outer sleeve (sometimes referred to as the "outer openings") are arranged axially such that a forward (i.e., in the direction of connection) edge of the outer openings is spaced forwardly of a rear edge of the aligned openings on the inner sleeve to provide an axial space sufficient to receive the leading edge of the blade of the disconnecting tool.

For clarity, the blade of a flat screw driver (i.e., as opposed to a Phillips screw driver) has two relatively short, flat sides and two relatively long, flat sides. The two long sides provide bearing surfaces for engaging the slot of a screw and applying torque. When the tool is inserted into the aligned openings of the inner and outer sleeves of the connectors of the present invention, one bearing surface of the tool (the one facing the direction of insertion of the first connector) lies adjacent the reaction surface on the forward edge of the slot in the outer sleeve, and the opposing bearing surface of the tool lies adjacent a reaction surface on the rear edge of the radially aligned slot on the inner sleeve.

By turning the tool (in the manner for inserting or removing a fastener), the inner sleeve of the first connector is moved rearwardly. The inner sleeve includes a member (a circular peripheral flange in the illustrated embodiment) which engages and translates the actuator sleeve axially rearwardly (i.e., in the direction of disconnection). The actuator sleeve of the connector includes an inner frusto-conical bearing surface which engages the tines of the spring to force the tines to an unlock, or release, position, freeing the latched second connector and permitting its removal.

The connectors may be assembled together without the tool. During connection, a leading portion of the insert of the second connector forces the tines of the locking spring forward in the direction of insertion of the second connector such that the tines "open" to form an enlarged receiving opening. When an outer peripheral rim on the insert of the second connector passes beneath the inner edges of the tines on the locking spring, the tines spring back to form a reduced opening, thereby engaging the rear surface of the peripheral ridge on the insert extension of the second connector, and locking the two connectors together in the assembled, operative position.

As indicated above, to disconnect the connector, the tool is inserted into aligned openings, one on the outer sleeve, and the other on the inner sleeve. The tool is then twisted to translate the spring release actuator which forces the tines to the open or unlock position so that the second connector may be removed manually.

BRIEF DESCRIPTION OF THE DRAWINGS

FIG. 5 is a perspective view of the outer sleeve of the first connector; and FIG. 6 is a perspective view of the inner sleeve of the first connector.

DETAILED DESCRIPTION

Figure 1:
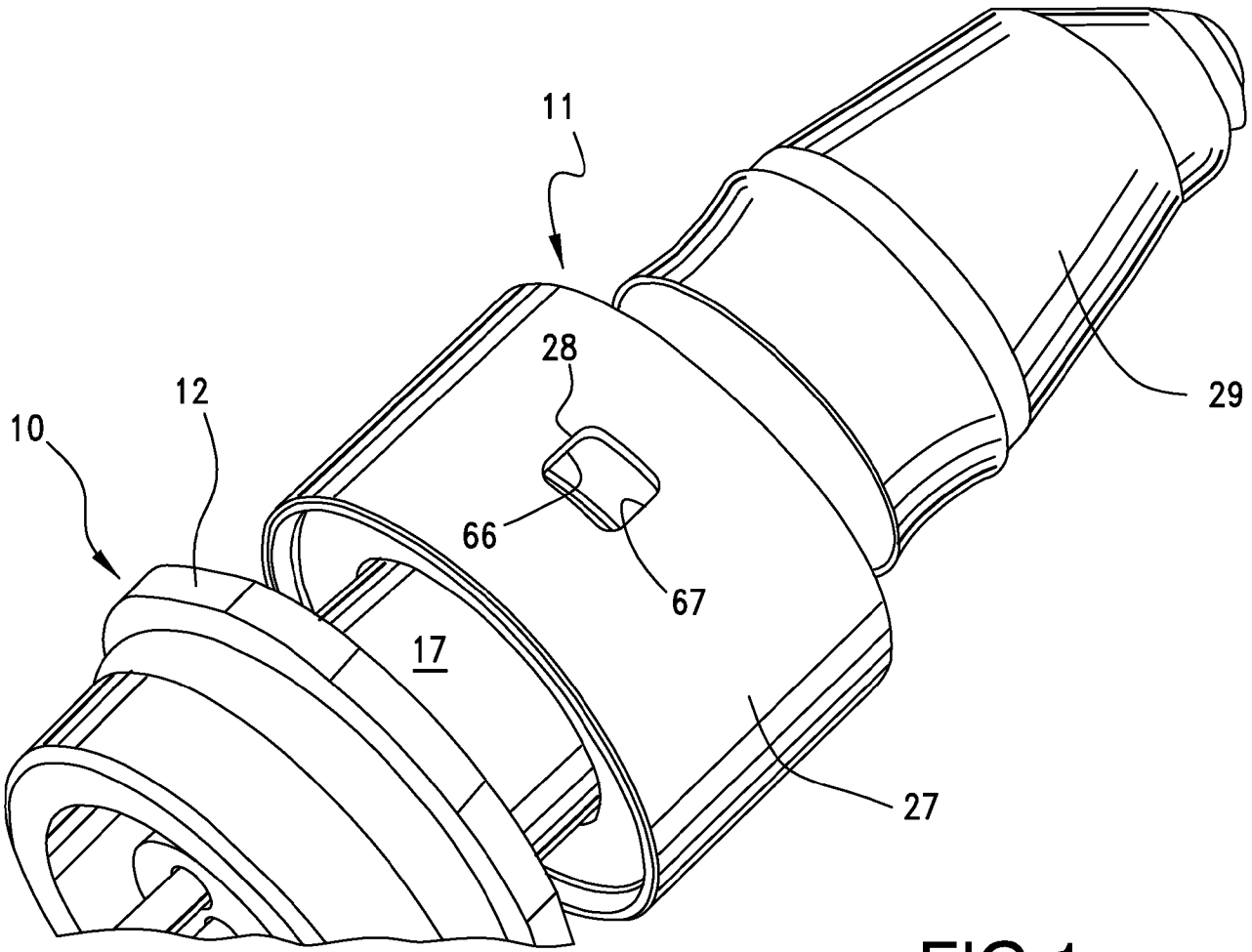
FIG. 1 is a fragmentary perspective view of two mating electrical connectors incorporating the present invention in assembled relation.
Figure 2:
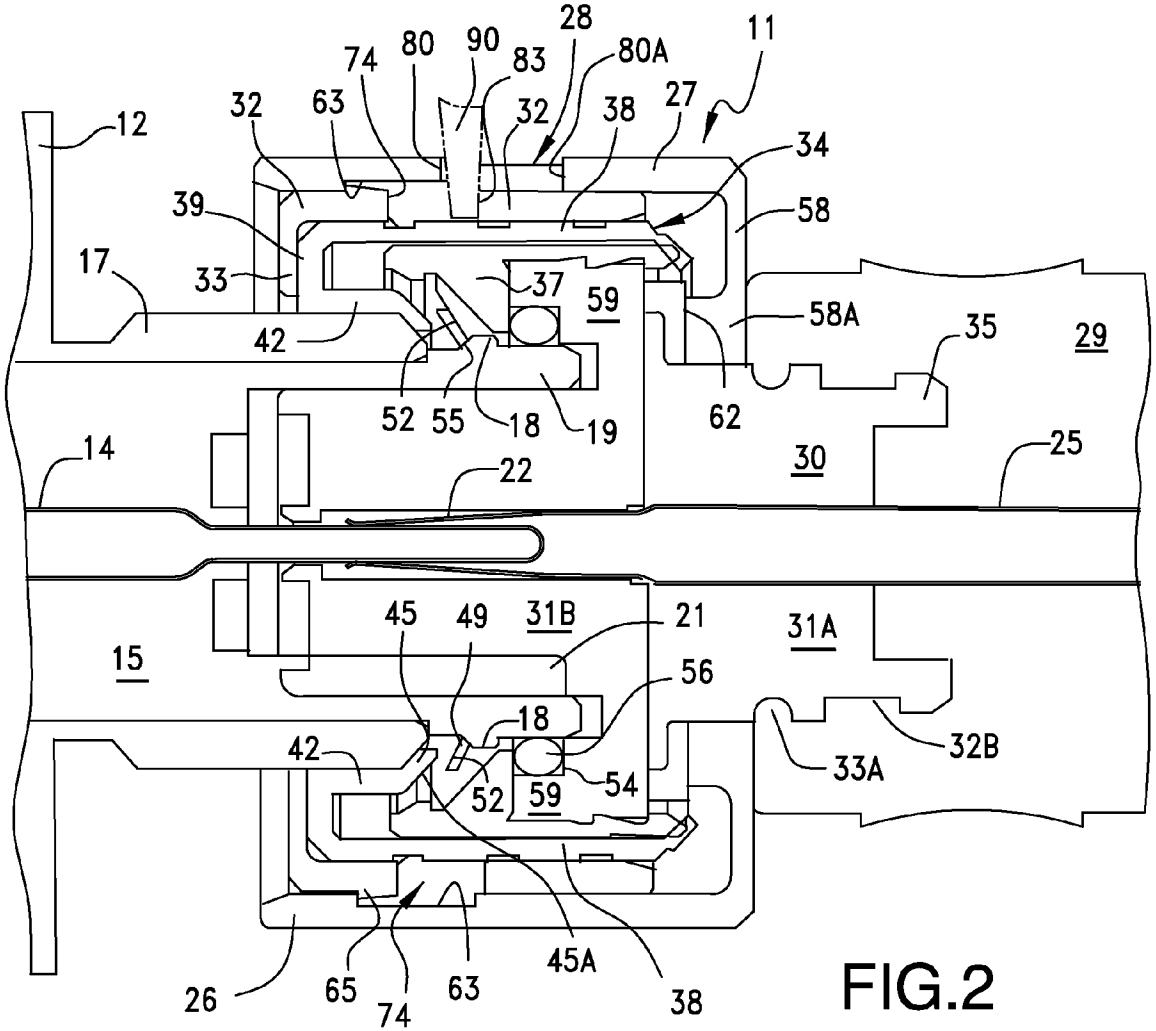
FIG. 2 is a fragmentary longitudinal cross-sectional view of the two connectors of FIG. 1 and taken along a plane extending along the axes of the two connectors in the connected or assembled position with an uncoupling tool (shown in fragmentary form) inserted between the reaction surfaces of the openings in the inner and outer sleeves, prior to uncoupling.

Referring first to FIG. 1, the present invention relates to a mating pair of electrical connectors including a male connector 10 and a female connector generally designated 11. The connectors 10, 11, are sometimes referred to as "quick disconnect" or plug-type connectors. The male connector 10 may be conventional, and it includes a rigid housing 12 typically formed of a hard plastic or other synthetic material including a forwardly extending plug member or extension 17 in which a plurality of male connector elements (not shown in FIG. 1) are rigidly embedded. One of the male connector elements is seen in FIG. 2 in the form of a pin, designated 14. The connector pin 14 as well as any other connecting pins in the male connector 10 are embedded, as seen in FIG. 2, in a rigid, non-conducting body referred to as an "insert" and designated 15. There may be as many as six or more contact pins in each connector, depending upon the design and function of the connector.

The housing 12, as seen in FIG. 2, extends forwardly (i.e., in the direction of connection of the connector 10 with connector 11) to include the plug member 17, which houses the insert 15 and connector member, or pin, 14. The insert 15 extends forwardly beyond the distal end of the plug member 17 and includes an outer peripheral extension 19 which is provided with a circumferential rim or ridge 18, the function of which will be explained presently. A key elongated in the direction of connection, shown at 21 in FIG. 2, may be included on the interior of the plug extension 19 and received in a corresponding keyway on the female connector 11 (to be described), to assure proper alignment of the male connecting elements 14 with corresponding female connecting elements such as the socket 22 shown in FIG. 2. Each female connecting element 22 (there typically are one for each connector pin) is connected to a conducting wire 25 provided with an insulating sheath. Connectors 10 and 11 are designed to electrically connect two cables, each having a plurality of wires. As with the male connector 10, the female connector 11 is referred to as having a "forward" portion in the direction of connection to the male connector (that is to the left in FIG. 2) and a "rear" portion, which is to the right side as seen in FIG.

2, and remote from the male connector. As mentioned, "forward" when referring to the male (or mating) connector 10 is opposite to "forward" when referring to the female (or first) connector 11.

Referring now to the female connector 11 shown in FIGS. 1 and 2, it includes an outer sleeve 27 which includes a series of circumferentially spaced openings, one of which is shown at 28 in FIG. 1. The female connector 11 also includes an overmold 29 which covers and protects the wire 25 to which the connector 11 is connected, and also protects the interface between the connecting wires and an associated non-conducting insert 30 (FIG. 2) in which the female connecting elements 22 are embedded. Again, only one female connecting element is shown for brevity and clarity, but as many as six or more separate sockets such as shown at 22 may be included in a typical quick-disconnect connector of the type shown. Both of the inserts 15, 30 are made of rigid insulating synthetic material as are substantially all other components of the two connectors as shown and described herein except for the connecting elements 14, 22, the associated lead wires connected to connecting elements and a retainer spring, to be described. As a person skilled in the art will readily understand, other components such as the outer sleeve 27 of the female connector 11, to be described, and the housing 12 of the male connector 10 may be made of metal for rigidity and strength.

The insert 30 of the female connector 11 includes a rear section 31A (to the right in FIG. 2) and a forward section 31B. The rear section 31A of the insert 30 includes first and second shaped peripheral grooves 33A, 33B and a ridged rear section 35 for securing the overmold 29 to the female connector 11. The overmold 29 is formed of a pliable, but strong synthetic non-conducting material.

Still referring to FIG. 2, spaced inwardly of the outer sleeve 27 of the female connector 11 is an inner sleeve 32, and received within the inner sleeve 32 is a spring actuator (or release sleeve, as it may be called) 34, also in the form of a cylindrical sleeve, extending about the insert 30. The inner sleeve 32 has a forward annular flange 33 engaging the front of the spring actuator 34. As will be described, the inner sleeve 32 is slidable (rearwardly in FIG. 2) relative to the outer sleeve 27, and the spring actuator 34 is arranged to slide with the inner sleeve 32, as will be described. Hence, the inner sleeve 32 and spring actuator 34 could be a single component, although it might add cost.

A spring mount 37, also having a generally cylindrical (or sleeve-like) shape, is attached to a receiving sleeve 59 of the female connector 11 and is received within the spring actuator 34. The spring actuator 34 is also formed, generally, as a surface of revolution, and it includes an outer wall 38.

The spring actuator 34 also includes an annular forward wall 39 which lies in a radial plane and extends about the plug extension 17, and it is then formed rearwardly into a cylindrical wall portion 42 which lies adjacent and receives the plug extension 17 of the male connector 10 when the male connector is inserted into the female connector 11. At the right side of the inner cylindrical wall 42, there is formed a frusto-conical lip forming an actuating wall or extension 45 which extends generally rearwardly and inwardly of the female connector 11 (that is toward the right and axially inwardly in FIG. 2) and forms a spring engagement surface designated 45A in FIG. 2.

Figure 3:
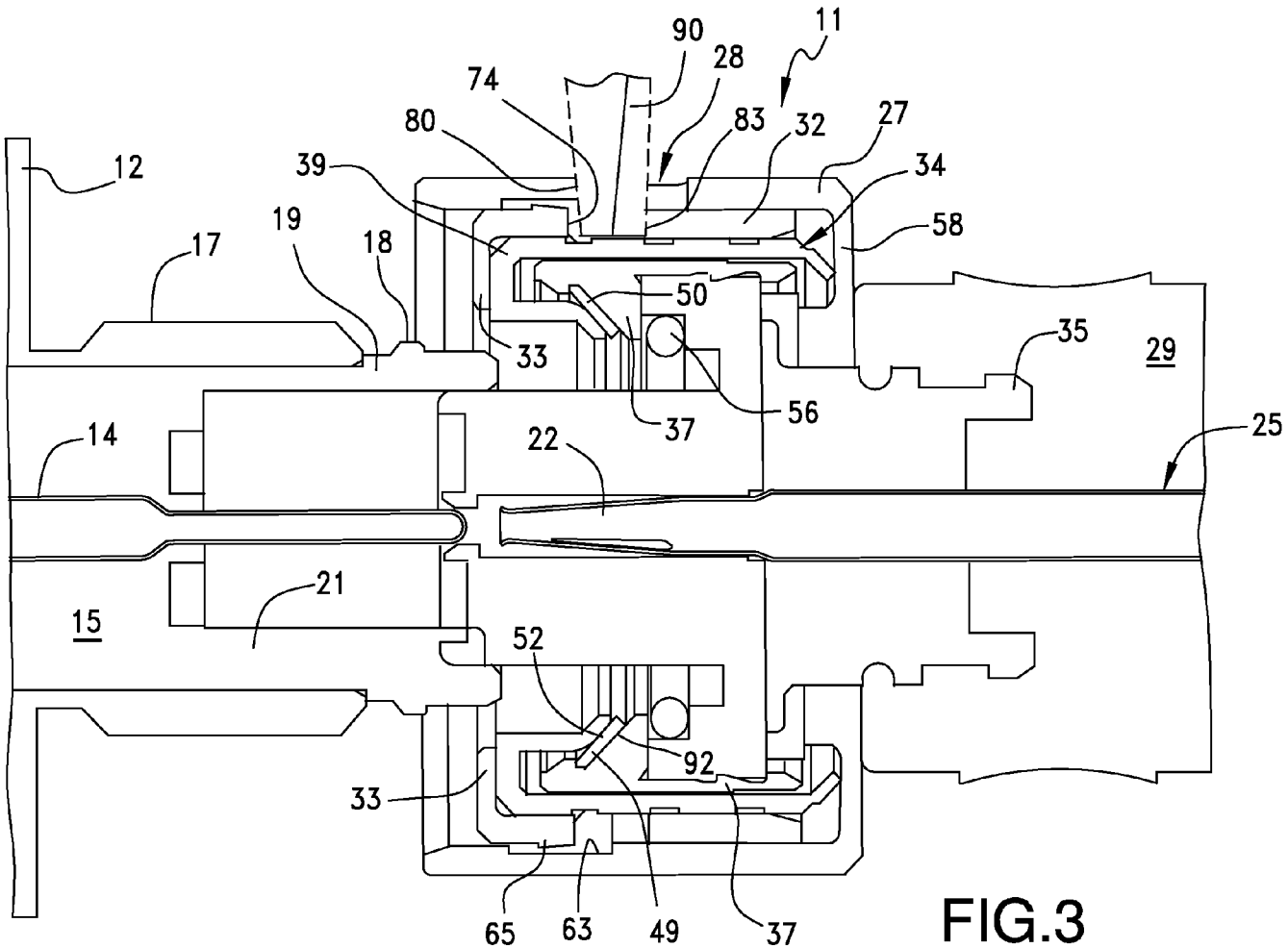
FIG. 3 is a view similar to FIG. 2 with the uncoupling tool turned so that the inner sleeve is in the release position to allow for disconnecting the two electrical connectors.

As seen in FIG. 3, the spring mount 37 receives and holds a generally circular spring member 49 which has a solid base ring 50 which extends completely around the insert 30 of the female connector 11 and is solid. The spring 49 is made of a resilient material such as beryllium or a spring steel and extending from the base ring 50 are a plurality of tines 52. The tines 52 are spaced from one another so that they individually hinge or flex relative to the base ring 50 which forms a rigid base for the spring and which serves to mount the spring to the spring mount 37.

Referring now to FIG. 2, when the inner sleeve 32 is in a forward or unbiased position as shown in FIG. 2, the tines 52 of the spring 49 are free to move to their original position, seen in FIG. 2, wherein the distal or interior edges of the tines form an opening of a comparatively small diameter. In FIG. 2, the tines 52 are shown only partially due to the plane of the section view which is FIG. 2. Thus, the tines, as shown in FIG. 2, engage the annular rear surface 55 of the retainer ridge 18 of extension 19 of the male connector 10, thereby securing the male plug in the connected position of FIG. 2. However, when the spring actuator 34 is placed in the right-hand (or release) position as shown in FIG. 3, the frusto-conical actuator wall 45 of the spring actuator 34 moves or bends the individual tines 52 of the spring 49 counterclockwise as seen in FIG. 2—that is, primarily toward the right and center axis. However, in moving in such a manner, the tines 52 as a collective group move toward the right and radially outward as seen in FIG. 2, forming an enlarged opening permitting removal of the male connector 10 by permitting the ridge 18 of the male connector's extension 19 to be withdrawn.

Still referring to FIG. 2, the annular extension 19 of the male insert 15 is disposed radially inward from an annular recess 54 formed in an annular receiving sleeve 59 which is an integral part of the insert 30. Annular receiving sleeve 59 is spaced outwardly of the central plug section in order to form a receiving sleeve for the male connector 10. A sealing O-ring 56 is received in the annular recess 54 (seen compressed in FIG. 2) to form a seal with the extension 19 of the insert 15 of the male connector 10.

Turning now to the outer sleeve 27 (FIG. 2), it includes a rear annular wall 58, the innermost portion of which is comparatively thick as at 58A so as to be located axially between the forward surface of the overmold 29 and the rear surface of a cylindrical member 62 having a cross section in a generally L shape, and forming a part of the female connector's insert 30. It is in this manner that the outer sleeve 27 is fixedly attached to the female connector 11.

On the inner surface of the forward portion wall 26 of the outer sleeve 27 is an annular groove or recess 63. The recess 63 receives an annular barbed portion 65 on the outer surface of the inner sleeve 32. Comparing FIG. 2 with FIG. 3, when the inner sleeve 32 is located in a forward position, as seen in FIG. 2, the barb 65 engages an inner surface of the forward portion wall 26 defining the inner groove 63 in the outer sleeve 27. However, when the inner sleeve 32 is moved to the right (inserted position) as seen in FIG. 3, the forward peripheral flange 33 of the inner sleeve 32 engages the forward surface of the adjacent annular wall 39 of the spring actuator member 34, moving the spring actuator 34 to the right, as seen in FIG. 3, thereby causing the spring engagement surface 45A of the frusto-conical actuator wall 45 to move the tines 52 of the retainer spring 49 to the outer, or release position,—that is, free of the exterior retainer ridge 18 on the male insert extension 19, as seen in FIG. 3. Thus, the inner edge portion of the tines 52 are moved into a position of increased diameter, freeing retainer ridge 18 of the extension 19 of the insert 15 of the male connector 10, permitting the male connector to be removed from the female connector 11 as seen in FIG. 3.

Figure 4:
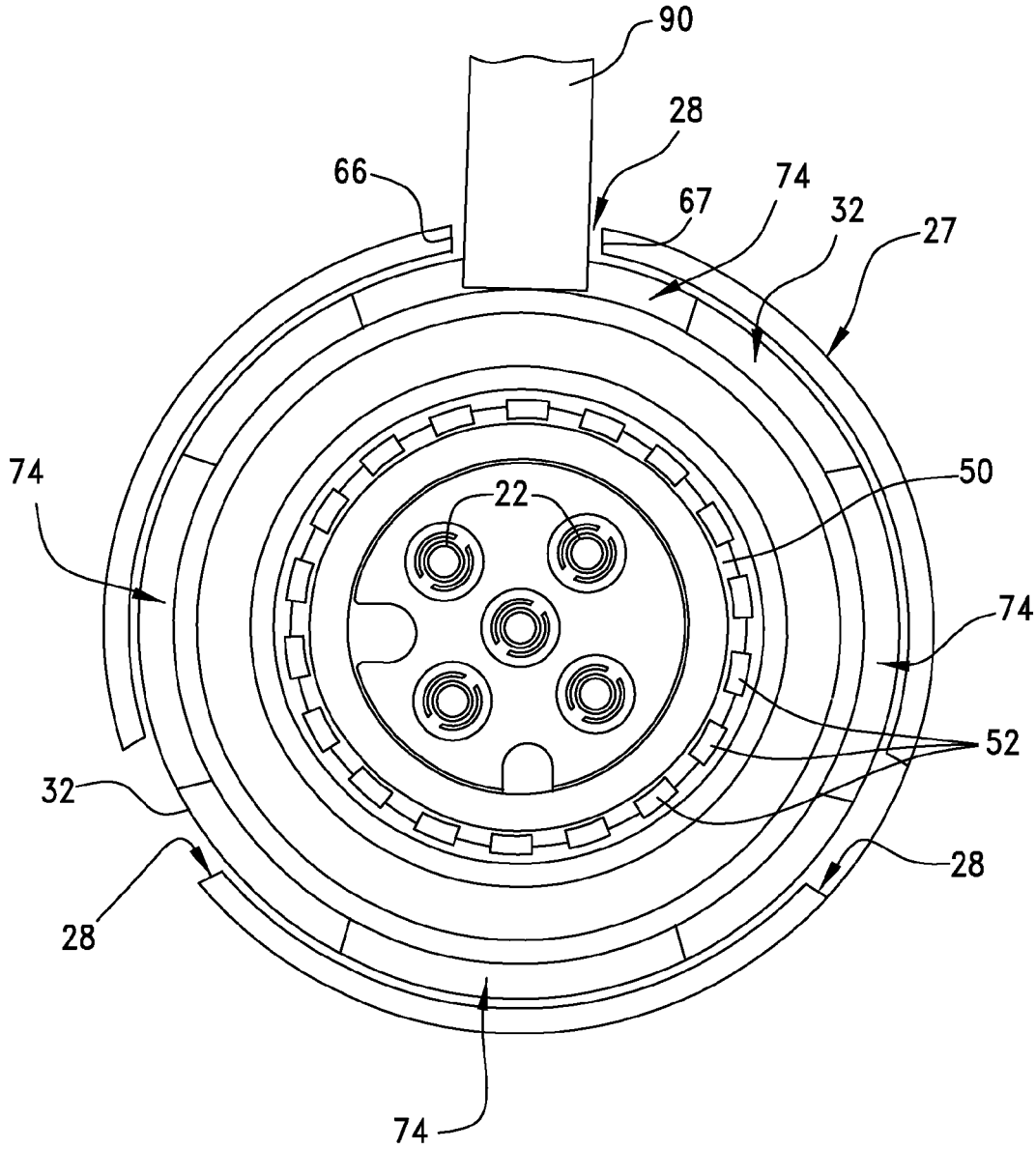
FIG. 4 is a transverse cross-sectional view of the two connectors taken in a plane perpendicular to the axes of the connectors and extending through the openings in the inner and outer sleeves, with the blade of the uncoupling tool shown positioned within aligned openings in the inner and outer sleeves.

Turning now to the structure which permits actuation of the spring actuator 34 from the locking position of FIG. 2 to the release position of FIG. 3, the outer sleeve 27 has a series of openings 28 (FIGS. 1 and 4) spaced at equal annular increments about the outer surface of the outer sleeve. For example, there are shown three openings 28 spaced at 120° increments about the outer sleeve 27. The straight line edge-to-edge distance between opposing sidewalls (66, 67 in FIG. 4) of each of these openings 28 may be 0.157 inches. A set of four generally rectangular openings, such as those designated 74 in FIGS. 2, 3, and 4 is placed at equal annular increments about the outer surface of the inner sleeve 32. The circumferential straight line distance of the side edges of the openings 74 may be 0.437 inches nominally. With this arrangement of openings in the inner and outer sleeves 32, 27, it is highly likely that there will be alignment of at least one opening 74 on the inner sleeve 32 and one opening 28 on the outer sleeve 27.

Turning now to FIGS. 2 and 3, the opening 28 on the outer sleeve 27 includes a forward surface 80 and a rear surface 80A. All of the openings on the outer sleeve include similar surfaces. All such forward surfaces in the openings 28 on the outer sleeve 27 lie in the same radial plane. These surfaces may be referred to as "reaction" surfaces, as will be appreciated from the following description. Similar reaction surfaces 83 are formed on the rear edges of each of the openings 74 on the inner sleeve 32 as shown in FIGS. 2 and 3. It can be seen that the axial spacing between the forward reaction surface 80 of the opening 28 in the outer sleeve 27 and the forward facing (rear) reaction surface 83 of the opening 74 in the inner sleeve 32 is arranged such that a tool such as a small blade screw driver, shown in fragmentary form at 90 in FIGS. 2 and 3, may be inserted in this space. This type of blade 90 has an elongated side, or edge, and a short side. The width of the screw driver blade 90 (the blade is shown only in partial form in FIG. 2) is shown in FIG. 4. The width of the blade 90 shown in FIG. 4 is greater than the width of its edge shown in FIG. 2, permitting the operator to exert considerable torque by turning the screw driver, as illustrated in FIG. 3. By rotating the screw driver about its longitudinal axis as shown in FIG. 3, the blade 90 of the screw driver axially displaces the inner sleeve 32 relative to the outer sleeve 27 and the outer opening 28 relative to the inner opening 74 because the outer sleeve 28 is engaged and maintained in fixed position on the female connector 11 by insert 30 and overmold 29 as shown in FIG. 2. Inner sleeve 32 is displaced to the right as shown in FIG. 3 by the above-described rotation of blade 90 (that is, rearwardly relative to the direction of insertion for the female connector 11). This movement of the inner sleeve 32 rightwardly as shown in FIG. 3 causes the spring engagement surface 45A of actuator 34 to engage the tines 52 and move them to the release position, i.e., to the right as seen in FIG. 3. Rightward displacement of the inner portions of the tines 52 is limited by an adjacent surface 92 of the spring mount 37.

When the screw driver blade 90 is rotated back to its original position as shown in FIG. 2 and removed, the action of the spring tines 49 is such as to bias the spring actuator 34 forwardly (to the left as shown in FIG. 3), thereby returning the inner sleeve 32 to its initial position shown in FIG. 1, wherein the female connector 11 is configured for re-use.

While particular embodiments of the present invention have been shown and described, it will be obvious to those skilled in the relevant arts that changes and modifications may be made without the departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The invention claimed is:

1. An electrical connector comprising:

a first connector member having an open annular end portion and a first electrical element, wherein said open annular end portion is adapted to receive an annular insert of a second connector member in a tight-fitting manner;

a second connector member having a second electrical element and an annular insert having an open end disposed about said second electrical element, said annular insert further including an upraised annular rim portion disposed on an outer surface and extending about the circumference of said annular insert; and wherein said first and second electrical elements are in electrical contact when said second connector member's annular insert is inserted in said first connector member's annular end portion;

an annular outer sleeve fixedly disposed on and extending about an outer surface of said first connector member and having a plurality of spaced outer apertures disposed about its circumference;

an annular inner sleeve disposed on and extending about an outer surface of said first connector member and axially movable on said first connector member and having a plurality of spaced inner apertures disposed about its circumference, wherein said inner sleeve is disposed between said first connector member and said outer sleeve;

a resilient annular retainer spring disposed in said open end portion of and attached to said first connector member and adapted to receive the second connector member's cylindrical insert and engage its upraised annular rim portion for locking said first and second connector members together, and an annular actuator sleeve disposed about the open end portion of said first connector member and axially movable on said first connector member, wherein said actuator sleeve is disposed adjacent to and between said inner sleeve and said retainer spring;

wherein a pair of outer and inner radially aligned apertures are adapted to receive in engagement a flat end of a blade of a tool in a first orientation, and wherein when said tool is axially rotated to a second orientation, said annular inner sleeve is engaged and axially displaced by the blade of said tool so as to engage and axially displace said actuator sleeve into engagement with said annular retainer spring for radially expanding a portion of said annular retainer spring out of engagement with the upraised annular rim portion of the second connector member's cylindrical insert and releasing said first connector member from said second connector member.

2. The electrical connector of claim 1, wherein said second connector member is axially displaced in a first direction in positioning its annular insert in the open end portion of said first connector member, and wherein said inner sleeve, said actuator sleeve and a portion of said retainer spring are displaced in said first direction in releasing said second connector member from said first connector member.

3. The electrical connector of claim 1, wherein said tool is a flat end screw driver.

4. The electrical connector of claim 1, wherein said annular outer and inner sleeves are freely and independently rotatable about said first connector member.

5. The electrical connector of claim 4, wherein said outer sleeve includes m equally spaced first apertures disposed about its circumference and said inner sleeve includes n equally spaced second apertures disposed about its circumference, where $m \neq n$.

6. The electrical connector of claim 5, wherein m=3 and n=4.

7. The electrical connector of claim 4, wherein said first apertures are of equal circumferential length X and said second apertures are of equal circumferential length Y.

8. The electrical connector of claim 7, wherein Y>X.

9. The electrical connector of claim 1, wherein said retainer spring includes an outer ring member and a plurality of spaced tines attached to and extending inwardly from said ring member.

10. The electrical connector of claim 9, wherein said tines are inclined on said ring member in a direction of insertion of said second connector member in said first connector member.

11. The electrical connector of claim 9, wherein an inner end of each of said tines engages the upraised annular rim portion of the second connector member's cylindrical insert in locking the first and second connector members together.

12. The electrical connector of claim 9, wherein said actuator sleeve includes an inner frusto-conical lip adapted to engage and displace outwardly inner portions of said inwardly extending tines out of engagement with said upraised annular rim in releasing said second connector member from said first connector member.

13. The electrical connector of claim 1, wherein the flat end of the tool's blade includes a first shorter dimension and a second longer dimension arranged 90° with respect to one another, and wherein said outer and inner radially aligned apertures include respective first and second reaction surfaces engaged by the flat end of said blade when said tool is rotated to said second orientation.

14. The electrical connector of claim 13, wherein the distance between said first and second reaction surfaces when said pair of outer and inner apertures are aligned is approximately equal to said first shorter dimension of the flat end of said blade.

* * * * *